US005669322A

United States Patent [19]

Huzjak

[11] Patent Number: 5,669,322

[45] Date of Patent: Sep. 23, 1997

[54] TROLLING MOTOR EXTENSION HANDLE BRACKET

[76] Inventor: George P. Huzjak, 1826 S. 71st St., West Allis, Wis. 53214

[21] Appl. No.: 417,301

[22] Filed: Apr. 5, 1995

[51] Int. Cl.[6] ..... B63H 20/12

[52] U.S. Cl. ..... 114/146; 440/6; 440/63

[58] Field of Search ..... 114/14 AR, 162, 114/146, 153; 440/6, 63; 74/544

[56] References Cited

U.S. PATENT DOCUMENTS

| | | | |
|---|---|---|---|
| 1,461,355 | 7/1923 | Irwin | 74/544 |
| 2,600,852 | 6/1952 | Coots | 440/63 |
| 2,747,425 | 5/1956 | Ohlau | 74/480 B |
| 3,046,040 | 7/1962 | Luper | 403/388 |
| 3,274,849 | 9/1966 | Hanson | 74/544 |
| 3,750,621 | 8/1973 | Hoyt | 75/515 |
| 4,624,206 | 11/1986 | Frye et al. | 114/146 |
| 4,656,960 | 4/1987 | Davenport | 114/146 |
| 4,698,032 | 10/1987 | Hill | 440/6 |
| 4,915,051 | 4/1990 | Martinek | 114/162 |
| 5,040,432 | 8/1991 | Carlstedt | 74/544 |
| 5,046,974 | 9/1991 | Griffin, Jr. et al. | 440/63 |

FOREIGN PATENT DOCUMENTS

| | | | |
|---|---|---|---|
| 592028 | 2/1960 | Canada | 287/54 B |

*Primary Examiner*—Sherman Basinger
*Attorney, Agent, or Firm*—Wheeler Kromholz & Manion

[57] ABSTRACT

A trolling motor extension handle bracket for attaching any sufficiently rigid member having a substantially circular cross-section to the handle or shaft of a trolling motor. The bracket has a pivot end and a handle receiving end. The pivot end is pivotally connected to a clamping assembly clamped to the trolling motor. The receiving end has a first semicircular channel formed therein, the channel being perpendicular to the longitudinal axis of the bracket. A second semicircular channel is also formed therein perpendicular to the first channel. Either channel is capable of receiving the tubular member which will serve as the trolling motor extension handle. Structures such as broom handles, dowel rods, pipes, and conduit may be utilized as the trolling motor extension handle.

4 Claims, 4 Drawing Sheets

TROLLING MOTOR EXTENSION HANDLE BRACKET

BACKGROUND OF THE INVENTION

Trolling motors are often utilized on fishing boats as an auxiliary or secondary boat propelling means. Trolling motors are typically smaller in size and power rating than the fishing boat's primary motor. The function of the trolling motor is to slowly move the boat while fishing. While under the power of a trolling motor, the boat can easily be maneuvered into and out of bays, weed beds, shallow streams, etc. Furthermore, it is often advantageous to slowly move the boat as each fisherperson's bait also moves with the boat. As the baits move in the water, as opposed to staying in the same location, they appear more real or life-like to the fish.

In order to better balance the boat and to enable its occupants to move safely throughout the boat, it is often desirable to attach an extension handle to the trolling motor. The extension handle allows the boat operator to control the trolling motor from different positions within the boat and maintain an equal weight distribution within the boat. Prior art trolling motor extension handles come in an assembly which include clamping brackets and a dedicated extension handle. The clamping brackets are attached to the trolling motor and the dedicated extension handle is, in turn, attached to the brackets. See, for example, the prior art trolling motor extension handle assembly shown in FIG. 1.

The present invention eliminates the need for a dedicated extension handle by providing a novel bracket capable of receiving any elongated member having a substantially circular cross-section as an extension handle. It is an object of the present invention to provide a trolling motor extension handle bracket that can receive and accommodate any elongated member having a substantially circular cross-section as an extension handle. It is another object to provide such a bracket that is versatile and can be installed through the use of the clamping bracket on the trolling motor handle or on the trolling motor shaft. It is yet a further object to provide such a bracket that can pivot on at least one axis to allow for multiple extension handle positions. It is yet a further object to provide a trolling motor extension handle bracket that is of simple design and is easy to manufacture. These and other advantages of my invention will become evident in the following descriptions.

SUMMARY OF THE INVENTION

The invention comprises a trolling motor extension handle bracket. The bracket has a pivot end and a handle receiving end. The pivot end allows for the attachment of the bracket to the clapping bracket clamped to the trolling motor. The novel structure of the extension handle receiving end allows the user of my invention to utilize any substantially cylindrical structure or member as an extension handle. For example, a broomstick, pipe, or piece of conduit could be used. A dedicated extension handle, such as a handle having a flat flange portion, is not required. The receiving end is constructed to receive the handle along the longitudinal axis of the bracket or perpendicular thereto. Two semicircular channels perpendicular to each other are formed in the receiving end. The first channel lies parallel to the longitudinal axis and the second channel is perpendicular to the first. Each channel is sized to receive the extension handle having an substantially circular cross-section.

The receiving end has an aperture or opening formed therethrough for securely attaching the extension handle member to the bracket. A bolt is passed through an opening formed in the handle member and the opening in the bracket. The bolt is secured by a wing nut or other suitable means attached on the opposite side of the bracket.

A two-piece trolling motor clamping bracket assembly is provided for attachment to the trolling motor. The trolling motor bracket assembly has mating clamping members and a pair of fasteners including wing nuts. The clamping members can be positioned around the trolling motor shaft or the trolling motor handle. One of the clamping members has an extended portion having a pair of apertures formed therein. The pivot end of the extension handle bracket is pivotally connected to the extended portion of the clamping member by a third fastener. In the preferred embodiment, a rubber washer is placed between the extension handle bracket and extended portion of the clamping assembly to increase friction thereby maintaining the selected angular relationship between the components.

My trolling motor extension handle bracket can be fabricated from any suitable material. While cast aluminum is preferred, it is to be understood that plastic, wood, or another metal could be utilized.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
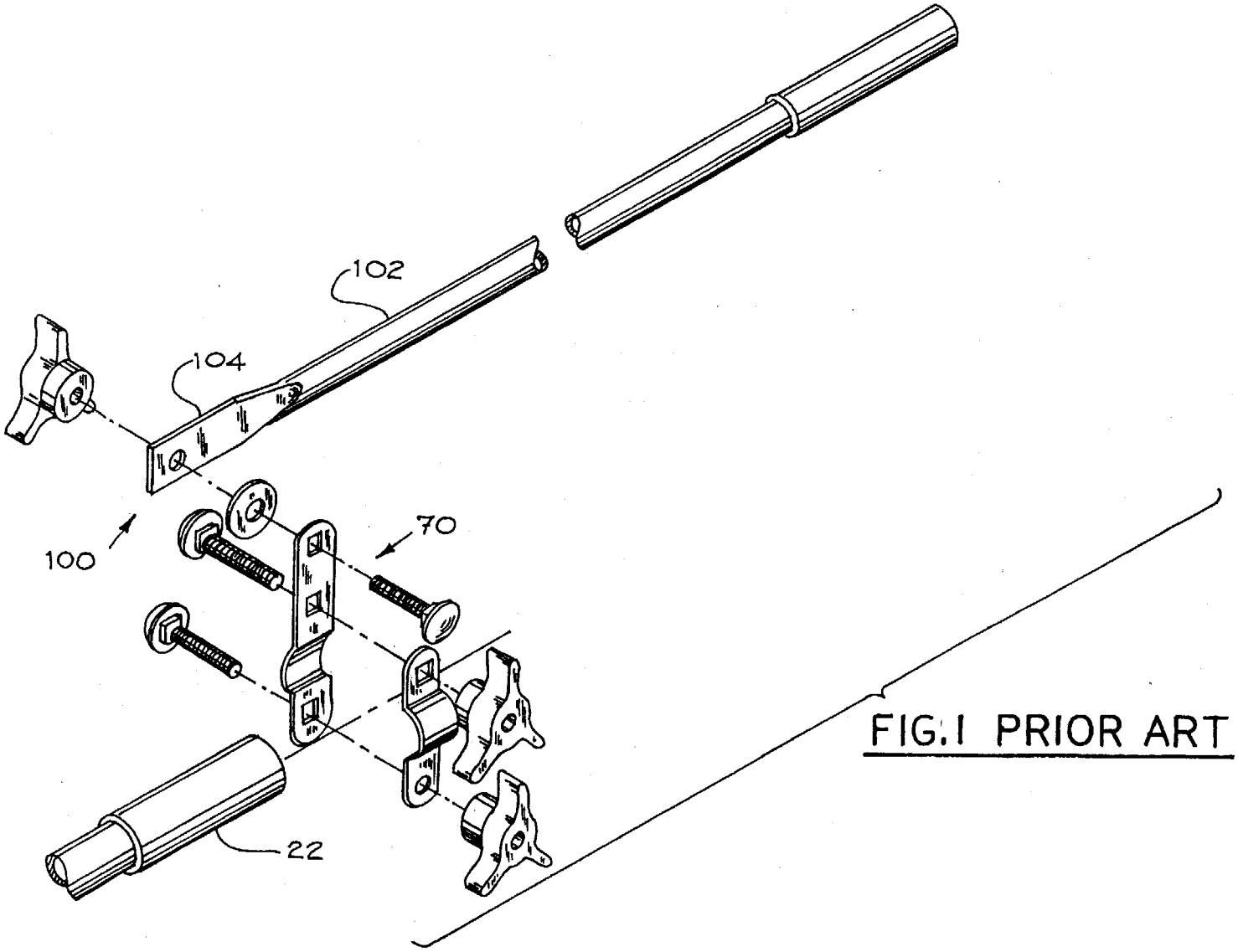
FIG. 1 PRIOR ART
FIG. 1 is an exploded perspective view of a prior art trolling motor extension handle assembly including a dedicated extension handle.

A prior art trolling motor extension handle assembly is shown at 100 in FIG. 1. This extension handle assembly is manufactured by Goldeneye Products, Inc. which is located in Minneapolis, Minn. One inherent problem with this prior art assembly 100 is that extension handle 102 must have a flattened flange portion 104 where it is connected to clamp assembly 70. My invention 10 allows the user to utilize any structure or member having a substantially circular cross-section as a trolling motor extension handle. Thus a dedicated extension handle 102 having a flange portion 104 like that of the prior art 100 is not required.

Figure 2:
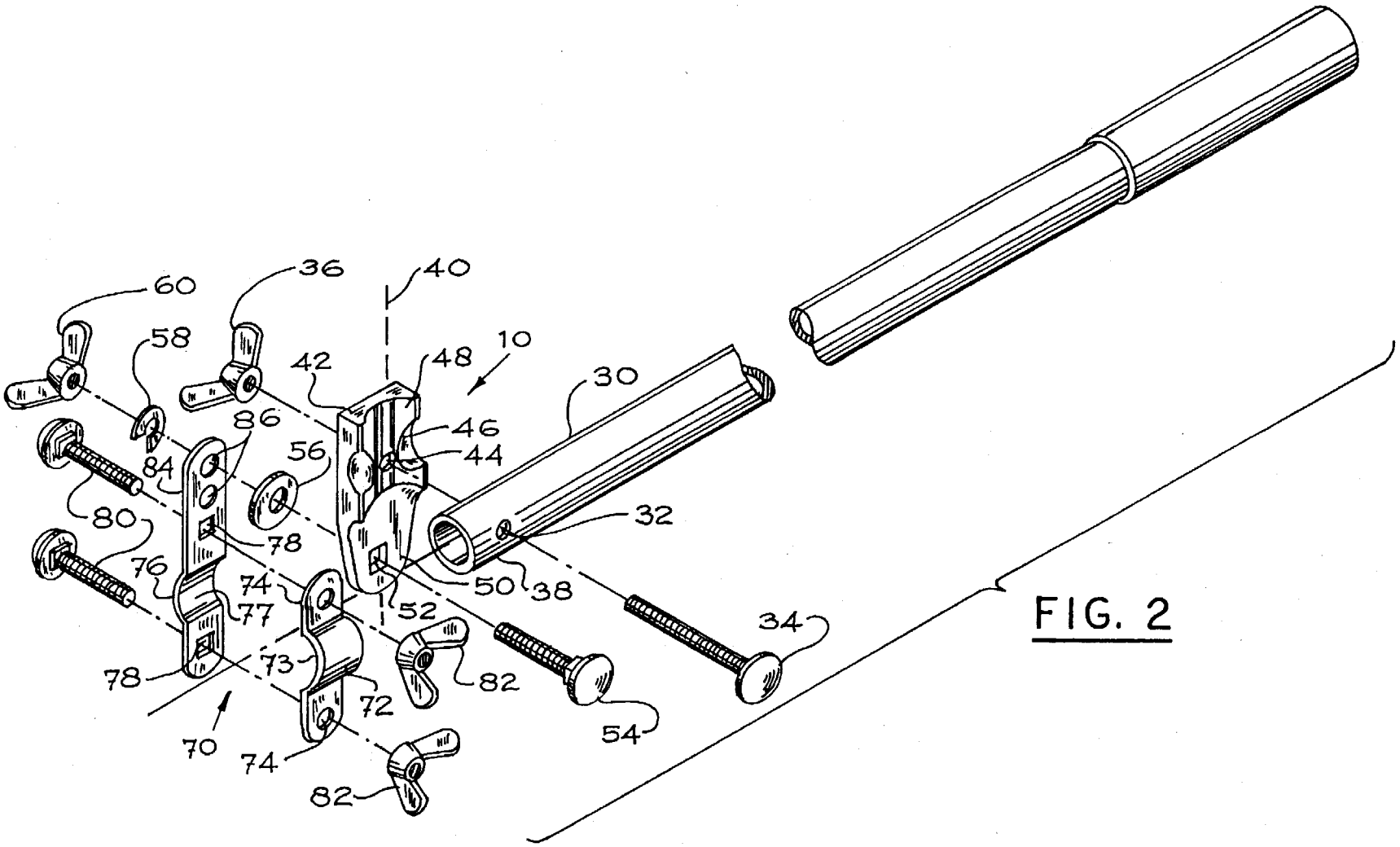
FIG. 2 is an exploded perspective view of a trolling motor extension handle assembly including my invention.
Figure 3:
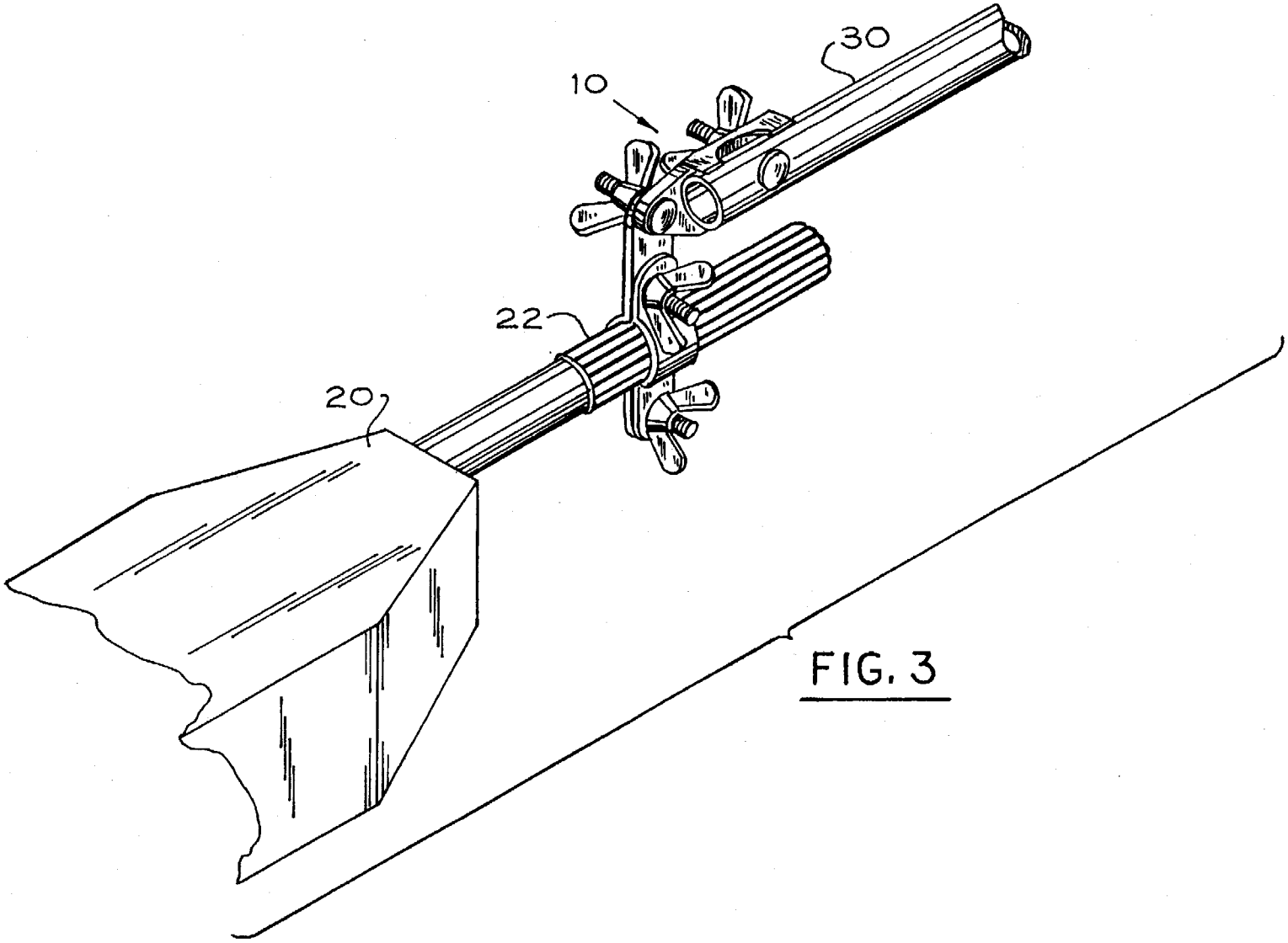
FIG. 3 is a perspective view of a trolling motor extension handle assembly including my invention and attached to the trolling motor handle.
Figure 4:
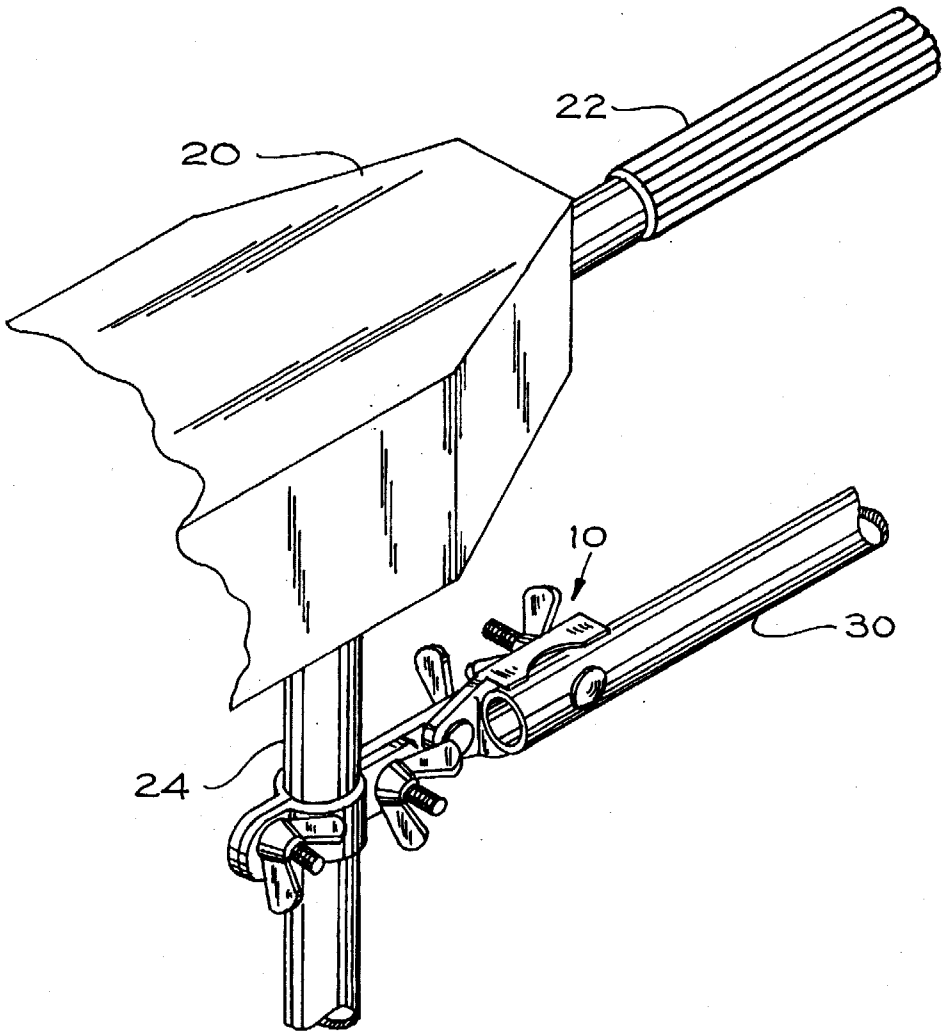
FIG. 4 is a perspective view of a trolling motor extension handle assembly including my invention and attached to the trolling motor shaft.

My invention, shown at 10 in FIGS. 2 through 4, comprises a trolling motor steering extension bracket. The bracket 10 has a receiving end 42 and a pivot end 50.

The receiving end 42 has two semicircular channels 46 and 48 formed therein. The channels 46 and 48 are perpendicular to one another and are sized to receive an extension handle 30 having a substantially circular cross-section. Extension handle 30 could be broom handle, pipe, dowel rod, conduit, or any other suitable structure being sufficiently rigid and having a substantially circular cross-section. The length of extension handle 30 can be whatever is desired by the user. Semicircular channel 48 runs along the longitudinal axis 40 of bracket 10. As shown in FIG. 2, channel 46 is substantially perpendicular to longitudinal axis 40. An aperture 44 is formed through receiving end 42 of bracket 10. In my preferred embodiment, the aperture 44 is located at the point of intersection of channels 46 and 48.

An aperture 32 is formed near end 38 of extension handle 30. A fastener 34 passes through aperture 32 in extension handle 30 and through aperture 44 in my bracket 10. A wing nut 36 is utilized to securely fasten these components together. A second aperture 52 is formed through pivot end 52 of my bracket 10. As shown in FIG. 2, aperture 52 has a square opening. Thus fastener 54, which has a square portion adjacent to its head, can be rotationally locked into opening 52 and will not rotate when wing nut 60 is tightened.

A trolling motor clamp assembly 70, which is well known in the art, is also provided. The clamp assembly 70 comprises a first clamp member 72, a second clamp member 76, a pair of clamp bolts 80, and a pair of clamp wing nuts 82. Clamp member 76 includes a pair of square apertures 78, similar in structure to aperture 52, for receiving clamping bolts 80, a semicircular clamping portion 77, and an extended end 84. A pair of openings 86 are formed in extended end 84. The selected opening 86 is utilized for pivotally connecting pivot end 50 of bracket 10 to clamp assembly 70. A fastener 54 is passed through and locked into opening 52, passed through a rubber washer 56, through selected aperture 86, through a lock washer 58, and finally secured by wing nut 60. Rubber washer 56 provides a frictional fit between the bracket 10 and clamp assembly 70. The rubber washer 56 helps to maintain the selected angular relationship between bracket 10 and clamp assembly 70 or trolling motor 20 and extension handle 30.

Clamp member 72 is similar to clamp member 76 except that it does not have an extended end. Member 72 includes a semicircular clamping portion 73 and a pair of openings 74.

As shown in FIGS. 3 and 4, trolling motor clamp assembly 70 can be placed around and clamped to either the trolling motor 20, handle 22 (FIG. 3) or the shaft 24 (FIG. 4). Fasteners 80 are passed through openings 78 in clamping member 76, through openings 74 in clamping member 72, and secured by wing nuts 82 to hold clamping assembly 70 to the selected component of trolling motor 20.

After installation, wing nut 60 can be loosened and extension handle 30 can be pivotally moved to its selected angular relationship with respect to trolling motor 20. Once a proper position is chosen by the operator of the trolling motor 20, wing nut 60 is retightened.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An extension handle bracket assembly for a trolling motor handle and a trolling motor shaft, the extension handle bracket assembly comprising:

an extension handle member;

an extension handle bracket having a pivot end and a receiving end;

said pivot end having an aperture;

said receiving end having two channels formed therein for receiving said extension handle member;

said two channels being perpendicular to each other;

said extension handle member connected to said receiving end;

a trolling motor bracket assembly having a first end including attachment means for alternative attachment to the trolling motor handle and the trolling motor shaft and a second end including attachment means for attachment to the pivot end;

a rubber washer located between said pivot end and said second end of said trolling motor bracket assembly.

2. The extension handle bracket assembly of claim 1 wherein said receiving end has a first aperture and said extension handle member has a corresponding second aperture, the assembly further including a fastener received by said first aperture and said second aperture.

3. A multi-purpose handle bracket assembly for a tolling motor having a trolling motor handle and a trolling motor shaft, the multi-purpose extension handle bracket assembly adoptable for alternate cooperation with said motor handle and said motor shaft, and comprising:

an extension handle member;

an extension handle bracket having a receiving end for receiving and supporting said extension handle member and a pivot end having an aperture;

a pivot member received by such aperture;

a trolling motor bracket assembly having a first end including attachment means for alternative attachment to the trolling motor handle and the trolling motor shaft and a second end including an aperture for receiving said pivot member;

means for securing said pivot member and said extension handle bracket and said trolling motor bracket assembly in relative angular relationship;

a rubber washer surrounding said pivot member and located between said pivot end of said extension handle bracket and said second end of said trolling motor bracket assembly; and the extension handle bracket receiving end having two channels formed therein for receiving the extension handle member.

4. The extension handle bracket assembly of claim 3 wherein said two channels of said receiving end are perpendicular to each other.

* * * * *